US006177881B1

(12) United States Patent
Castaneda et al.

(10) Patent No.: US 6,177,881 B1
(45) Date of Patent: Jan. 23, 2001

(54) VIBRATOR MOUNTING ASSEMBLY FOR A PORTABLE COMMUNICATION DEVICE

(75) Inventors: Julio C. Castaneda, Coral Springs, FL (US); Troy Frandsen, Flower Mound, TX (US); Benjamin J. Hafen, Sunrise; Amber E. Okoye, Miami Lakes, both of FL (US)

(73) Assignee: Motorola, Inc., Schaumburg, IL (US)

( * ) Notice: Under 35 U.S.C. 154(b), the term of this patent shall be extended for 0 days.

(21) Appl. No.: 09/038,918

(22) Filed: Mar. 12, 1998

(51) Int. Cl.[7] ..... G08B 5/22

(52) U.S. Cl. ..... 340/825.46; 340/407.1; 455/347

(58) Field of Search ..... 340/825.46, 825.44, 340/311.1, 40.71; 455/347, 351, 344

(56) References Cited

U.S. PATENT DOCUMENTS 5,437,607 * 8/1995 Taylor ..... 601/49
5,657,205 * 8/1997 Tamaru et al. ..... 361/761
5,898,364 * 4/1999 Gotou ..... 340/407.1

* cited by examiner

*Primary Examiner*—Michael Horabik
*Assistant Examiner*—Anthony A. Asongwed
(74) *Attorney, Agent, or Firm*—Barabara R. Doutre

(57) ABSTRACT

A vibrator assembly (100) for a radio (200) having a transducer (110) includes a front housing (102) having first and second recessed cavities (104, 106) within which a vibrator (108) and transducer (110) are seated. A unitary molded pad (122) is configured to cover the vibrator (108) and a portion of the transducer (110). When a bezel (128) is attached to the front housing (102) of the radio, the unitary molded pad (122) is compressed against the vibrator (108) to provide increased rigidity of the vibrator within the first recessed cavity (104). The unitary molded pad (122) transfers vibrations emanating from vibrator (108) to the radio surface while providing a seal about the transducer (110).

8 Claims, 2 Drawing Sheets

200

VIBRATOR MOUNTING ASSEMBLY FOR A PORTABLE COMMUNICATION DEVICE

TECHNICAL FIELD

This invention relates in general to portable radios and more specifically to vibrator assemblies used in portable radios.

BACKGROUND

Most new consumer portable communications equipment utilizes some type of a vibrator mechanism to alert the user of incoming data, messages, or calls. The vibrator, upon activation, generates vibrations which are transferred to the communication device housing causing the housing to shake thereby alerting the user. The mounting scheme of a vibrator into a portable communication device, such as a portable radio, largely determines its shake effectiveness. It is desirable that the vibrator be mounted as rigidly as possible within the radio housing so that maximum shake is achieved. As portable radios become smaller and more compact, it becomes critical that the vibrator assembly take up as little space as possible and be easy to assemble.

Currently, there are several widely used mounting schemes for vibrator assemblies. One mounting scheme mounts the vibrator to a printed circuit (PC) board within the radio housing. However, attaching the vibrator directly to the PC board usually requires some type of bracket reflowed onto the PC board to retain the vibrator or alternatively requires reflowing the vibrator directly to the PC board. There are also prior art vibrator mounting schemes which mount the vibrator directly to the radio housing, however, these schemes typically require the use of a separate boot mounted about the vibrator which can cause assembly stack up problems. Both of these mounting approaches have the further disadvantage of taking up large areas of internal housing space and incur some loss of vibration due to inefficient transmission of the shake to the outer radio housing.

Accordingly, there is a need for a vibrator assembly which effectively transfers the shake of the vibrator to the radio housing. Effective use of space within the radio housing as well as ease of assembly are also important parameters to address in any vibrator assembly.

DETAILED DESCRIPTION OF THE PREFERRED EMBODIMENT

Figure 1:
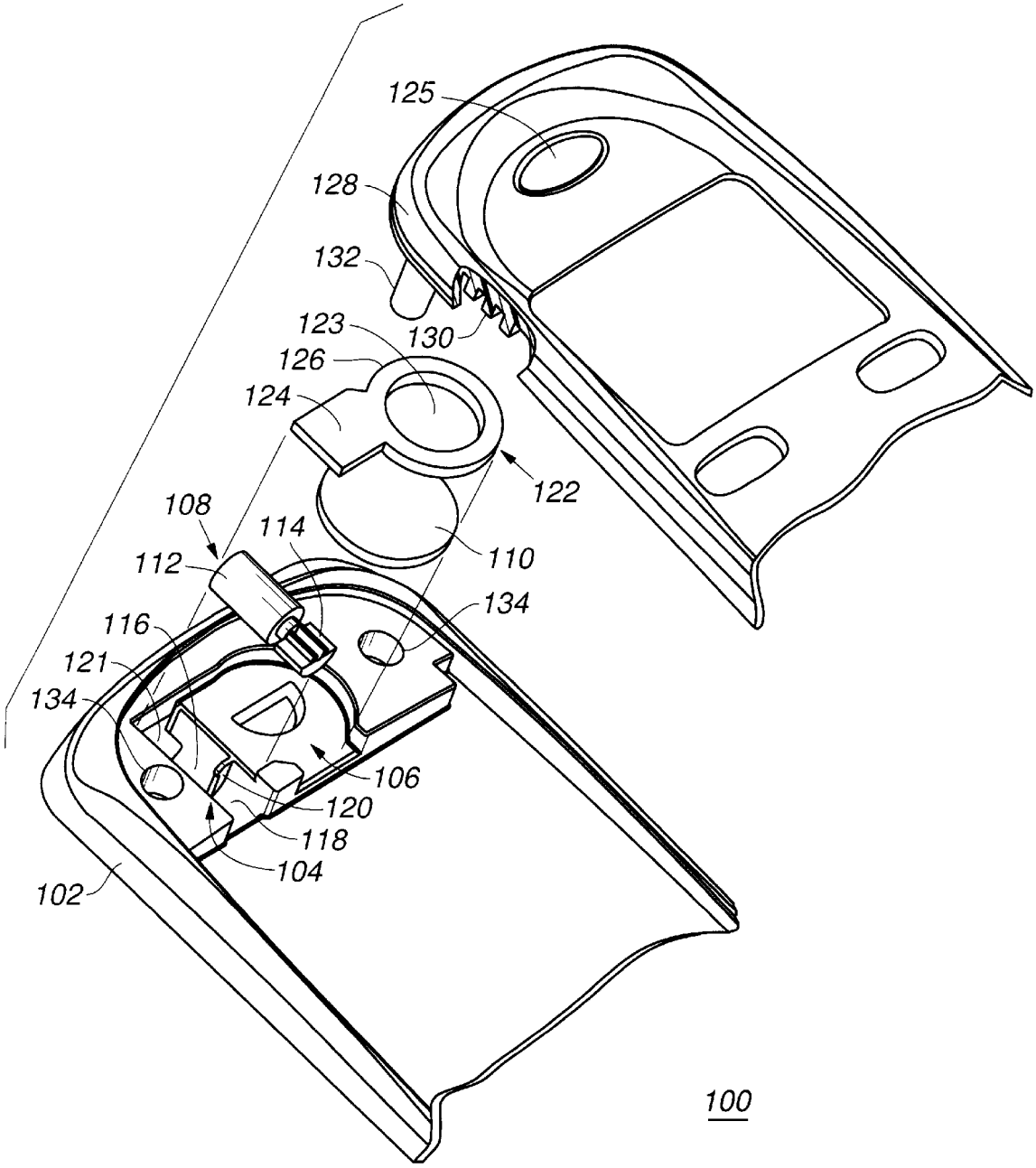
FIG. 1 is an exploded view of the vibrator assembly in accordance with the present invention.

While the specification concludes with claims defining the features of the invention that are regarded as novel, it is believed that the invention will be better understood from a consideration of the following description in conjunction with the drawing figures, in which like reference numerals are carried forward.

Referring now to FIG. 1, there is shown a vibrator assembly for a radio in accordance with the present invention. Assembly 100 includes a front housing 102 having first and second recessed cavities 104, 106 formed therein. The first recessed cavity 104 is formed to retain a vibrator 108 while the second recessed cavity 106 is formed to retain a transducer 110. Vibrator 108 is formed of a motor portion

112 and a counterweight portion 114. The first recessed cavity 104 is preferably formed of first and second halves 116, 118. The motor portion 112 of the vibrator 108 snap fits within the first half 116 of the first recessed cavity 104 and the counterweight portion 114 snap fits into the second half 118 of the first recessed cavity 104. Passive snaps 120 are preferably used to help retain the vibrator 108 within the first recessed cavity 104. The first recessed cavity 104 preferably includes an opening 121 formed therein to provide a passthru for wires or connectors (not shown) of the vibrator 108 and transducer 110.

In accordance with the present invention, a unitary molded pad 122 is configured to cover the vibrator 108 and a predetermined portion of the transducer 110, preferably the perimeter of the transducer. In accordance with the invention, the unitary molded pad 122 covers at least the motor portion 112 of the vibrator 108 and provides an opening 123 and seal 126 through which audio can be transferred from the transducer 110 to a speaker port 125.

In accordance with the present invention, assembly 100 further includes a bezel 128, or front cover, which couples to the front housing and compresses the unitary molded pad 122 between the vibrator 108 and bezel. By compressing the unitary molded pad 122 between the bezel 128 and vibrator 108, the vibrations are more effectively transferred to the bezel surface thereby providing an improved alert to the user. The unitary molded pad 122 thus transfers vibrations emanating from vibrator 108 to the radio surface while providing a seal about the transducer 110.

The bezel 128 preferably includes a boss 130 extending from its inner surface. Boss 130 aligns with the portion of the unitary molded pad 122 which covers at least the motor portion 112 of vibrator 108. As the bezel 128 couples to the front housing 102, the boss 130 presses against the pad 122 to compressibly retain the vibrator 108 within the first cavity 104. Using the boss 130 extending from the bezel 128 to increase the compression on the pad 122 increases the rigidity with which the vibrator 108 is captivated within the recessed cavity 104. This increased retention rigidity provides improved vibration transfer to the radio surface.

The bezel 128 is preferably formed a molded rigid or semi-rigid material, such as plastic. The bezel includes the speaker port 125 which aligns with the opening 123 of the unitary molded pad 122. The bezel 128 is preferably coupled to the front housing through a plurality of screw bosses 132 extending from the inner surface of the bezel. The bezel's screw bosses 132 align with and are inserted through corresponding apertures 134 formed in the front housing 102. Upon insertion of the screw bosses 132 through the apertures 134, the bezel 128 compresses the unitary molded pad 122 against the vibrator 108 and transducer 110. The boss 130 provides increased rigidity against the motor portion 112 of the vibrator 108. While shown and described in terms of screw bosses 132, one skilled in the art appreciates that other appropriate means of coupling the bezel to the front housing, such as snaps, may also be implemented.

Figure 2:
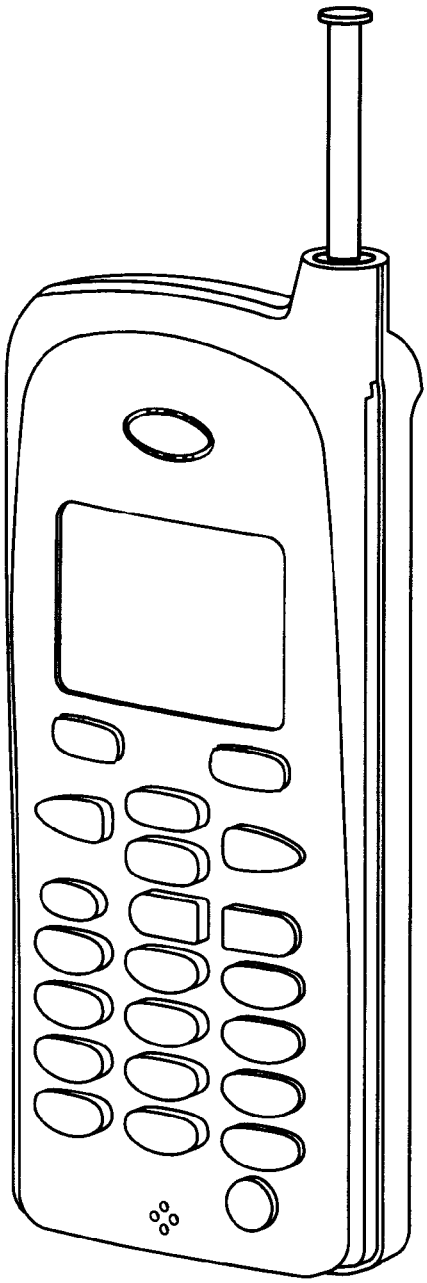
FIG. 2 shows a portable radio incorporating the vibrator assembly in accordance with the present invention.

FIG. 2 shows a radio incorporating the vibrator assembly described by the invention. Radio 200 provides both improved shake/vibration alert performance as well as a seal about the transducer/speaker port through the use of the unitary molded pad 122. The vibrator assembly described by the invention provides improved alert performance while eliminating the use of brackets and PC board mounting techniques. There is no need to reflow any of the components of the vibrator assembly described by the invention thus providing the advantage of improved ease of assembly in the manufacturing process of the radio. Furthermore, the assembly described by the invention eliminates the use of a separate boot for the vibrator thus reducing assembly stack up problems.

Accordingly, there has been provided a vibrator assembly which effectively transfers the shake of the vibrator to the radio housing. Effective use of space within the radio housing as well as ease of assembly are advantages achieved with the assembly described by the invention.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A vibrator assembly for a radio having a transducer, comprising:

a front housing having first and second recessed cavities formed therein, the first recessed cavity being formed in first and second halves, the second recessed cavity retaining the transducer;

a vibrator having a motor portion and a counterweight portion, the motor portion snap fitting within the first half of the first recessed cavity and the counterweight portion snap fitting into the second half of the first recessed cavity;

a unitary molded pad configured to cover a predetermined portion of the vibrator and a predetermined portion of the transducer, the unitary molded pad forming a seal about the transducer and providing an opening for audio; and a bezel coupled to the front housing, the unitary molded pad being compressed between the predetermined portion of the vibrator and bezel to transfer vibrations emanating from the vibrator to the front housing.

2. A vibrator assembly as described in claim 1, the bezel further comprising a boss extending therefrom and aligning with the unitary molded pad and the vibrator so as to compressibly retain the vibrator within the first cavity.

3. A vibrator assembly as described in claim 1, wherein the predetermined portion of the vibrator comprises the motor portion of the vibrator.

4. A vibrator assembly as described in claim 3, wherein the predetermined portion of the transducer comprises the perimeter of the transducer.

5. A vibrator assembly for a radio having a transducer and a vibrator, comprising:

a front housing having first and second cavities, the first cavity for retaining the vibrator, the second cavity for retaining the transducer;

a unitary molded pad having a first portion covering the vibrator and a second portion providing a seal about the transducer and having an opening to allow audio to pass therethrough; and a bezel seated upon the front housing so as to compress the unitary molded pad against the vibrator and form a seal between the transducer and the bezel, the unitary molded pad transferring vibrations from the vibrator to the front housing while providing a seal and audio port for the transducer.

6. A radio, comprising:

a vibrator;

a transducer;

a front housing having a first recessed cavity for receiving the vibrator, and a second recessed cavity for receiving the transducer;

a unitary molded pad for covering the vibrator and a perimeter of the transducer; the bezel and front housing fitting together such that the pad is compressed between the vibrator and the bezel; and wherein the unitary molded pad transfers vibrations emanating from the vibrator to the front housing while providing an audio port for the transducer.

7. A radio as described in claim 6, further comprising a boss extending from the bezel for rigidly retaining the vibrator within the first recessed cavity.

8. A radio as described in claim 7, wherein the unitary molded pad forms a seal about the transducer.

* * * * *